US005144098A

United States Patent [19]

VanDeusen

[11] Patent Number: 5,144,098

[45] Date of Patent: * Sep. 1, 1992

[54] CONDUCTIVELY-JACKETED ELECTRICAL CABLE

[75] Inventor: Herbert G. VanDeusen, Bear, Del.

[73] Assignee: W. L. Gore & Associates, Inc., Newark, Del.

[ * ] Notice: The portion of the term of this patent subsequent to Aug. 6, 2008 has been disclaimed.

[21] Appl. No.: 666,326

[22] Filed: Mar. 8, 1991

Related U.S. Application Data

[63] Continuation-in-part of Ser. No. 490,811, Mar. 8, 1990.

[51] Int. Cl.[5] ..... H01B 7/34

[52] U.S. Cl. ..... 174/36; 174/72 A; 174/102 SC; 174/106 SC; 174/115

[58] Field of Search ..... 174/36, 102 SC, 105 SC, 174/106 SC, 107, 115, 22 A

[56] References Cited

U.S. PATENT DOCUMENTS

| | | | |
|---|---|---|---|
| 4,096,346 | 6/1978 | Stine et al. | 174/36 |
| 4,327,246 | 4/1982 | Kincaid | 174/36 |
| 4,347,487 | 8/1982 | Martin | 174/36 X |
| 4,374,299 | 2/1983 | Kincaid | 174/36 |
| 4,454,379 | 6/1984 | Cleveland et al. | 174/107 |
| 4,472,597 | 9/1984 | Vematsu | 174/106 SC |
| 4,725,693 | 2/1988 | Hirsch | 174/107 |
| 4,731,504 | 3/1988 | Achille et al. | 174/107 |
| 4,785,138 | 11/1988 | Breit en bach et al. | 174/106 SC |
| 4,847,448 | 7/1989 | Sato | 174/103 |
| 4,855,534 | 8/1989 | O'Connor | 174/36 |

*Primary Examiner*—Morris H. Nimmo
*Attorney, Agent, or Firm*—Gary A. Samuels

[57] ABSTRACT

A conductively-jacketed electrical cable which provides continuous electrical contact from a drain wire through a metal-coated tape wrapped shield, a semiconductive adhesive layer applied to the tape on the reverse side from the metal coating, to a semiconductive jacket.

6 Claims, 4 Drawing Sheets

CONDUCTIVELY-JACKETED ELECTRICAL CABLE

RELATED APPLICATION

This application is a continuation-in-part of an application U.S. Ser. No. 07/490,811, filed Mar. 8, 1990.

FIELD OF THE INVENTION

The invention pertains to electrical signal cables having conductive jackets in order to reduce problems of electrostatic discharge in electronic systems.

BACKGROUND OF THE INVENTION

In the field of high frequency applications, the signal conductors of an electric signal cable are enclosed within one or more layers of conductive shielding to prevent leakage of electromagnetic energy either into or out of the cable. Also it has been found that conductive jackets can reduce problems of electrostatic discharge in electronic systems. Solutions to these problems have been attempted by using more than one layer of shielding, such as braided metal wire or tape, or multiple layers of metal coated polymer tape to provide an effective shielding. Multiple layers of shielding however usually make a cable relatively inflexible. Problems also occur in terminating such multiple shields to ground or in commonly grounding all layers of shielding. Many of the problems are outlined in detail in the background portions of U.S. Pat. Nos. 4,871,883, 4,371,742, and 4,347,487, and those portions of the references are hereby incorporated by reference.

Recently there has been interest in providing cables having conductive jackets, primarily to reduce problems of electrostatic discharge in electronic systems. When a conductive jacket is used with metal coated polymer tape shielding, a problem arises of how to achieve a conductive path from the jacket to the inner shield to eventually contact the drain wires which ground all conductive shielding layers. The metal side of the metal-coated polymer tape must face the inside of the cable so as to make contact with the drain wires to provide a cable having the best electrical performance. The polymer tape layer upon which the metal layer is coated lies between the metal layer and the conductive outer jacket and thus insulates the metal layer from the conductive outer jacket. One possible solution is to metal-coat both sides of the polymer tape. However, this structure dramatically stiffens the cable and makes processing very difficult.

Other solutions which have been tried include laser-etching of the polymer film in certain areas to expose the metal to the jacket, folding back the edge of the metal-coated polymer tape to expose the edge of metal to the jacket, cutting the aluminized polymer from the metal side of the tape in order to smear the edge toward the jacketed side, and applying the shield with less than 100% coverage (typically 150% coverage or 50% overlap is used) to expose the drain wires to the jacket.

None of these proposed solutions provided reliable contact between the jacket and shield while maintaining flexibility or processability.

SUMMARY OF THE INVENTION

The present invention comprises a conductively-jacketed cable having at least one metal center conductor for transmitting signals surrounded by electrical insulation. One or more conductive metal drain wires are positioned parallel to the insulated center wire. A metal-clad polymer tape coated on the opposite side from the metal with a thin semiconductive adhesive polymer film is wrapped around the center wire and the drain wires as a unit. Surrounding the tape-wrapped cable is a semiconductive polymer jacket, which may be tape-wrapped or extruded onto the cable. A conductive path is thereby provided between the jacket, the shield, and the drain wires. Two insulated center wires may be wrapped together with one or more drain wires as a unit with the metal-clad polymer tape coated on the opposite side from the metal with a thin semiconductive polymer film to give a twin-axial or a tri-axial cable, for example.

DETAILED DESCRIPTION OF THE INVENTION

With reference now to the drawings, a more detailed description of embodiments of the invention is given. A solution to the problem of firm reliable electrical contact between a conductive jacket and the shield of a cable is provided by the present invention by applying a very thin semiconductive adhesive polymer film over the polymer side of a metal-coated polymer tape wrapped around the primary insulation of the cable to serve as the shield to the signal-carrying center conductor.

Figure 1:
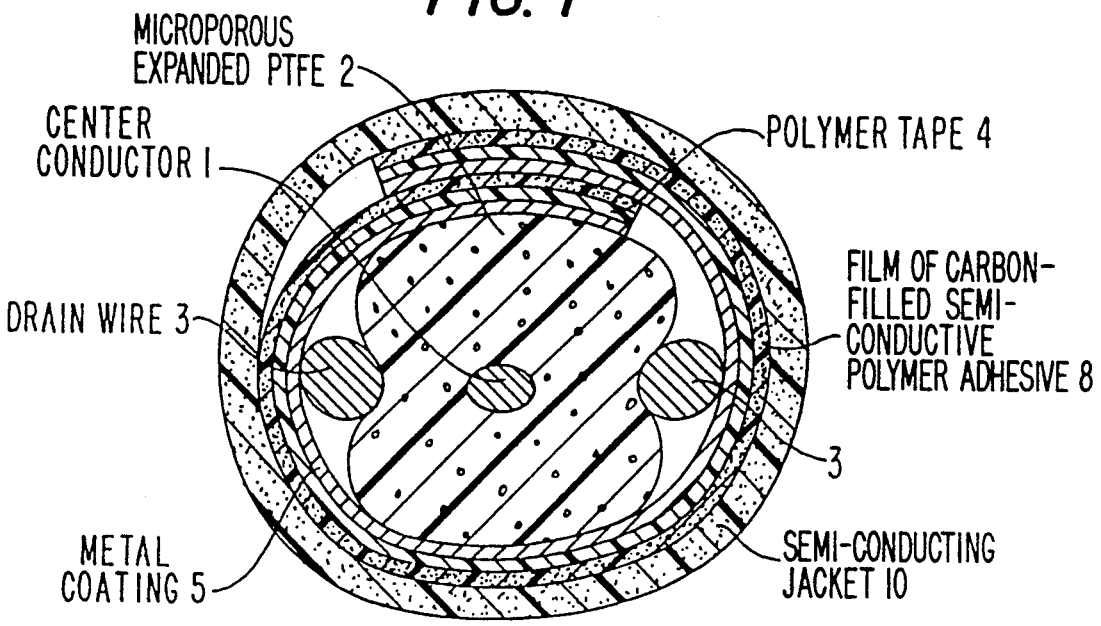
FIG. 1 shows a cross-sectional view of the cable of the invention.

FIG. 1 shows a cross-sectional view of the cable of the invention in which center conductor 1 is surrounded by primary insulation 2, which may be any customary insulation usually known in the art for this use, but preferably for this invention comprises a microporous polymer insulation, and most preferably comprises the microporous expanded polytetrafluoroethylene (PTFE) polymer material disclosed in U.S. Pat. Nos. 3,953,566, 4,187,390, 3,962,153, or 4,096,227, but may be other microporous polymers such as foamed polyolefins or foamed fluorinated ethylene propylene copolymer (FEP) or polyfluoroalkoxy tetrafluoroethylene polymer (PFA). Extending the length of the cable parallel to center conductor 1 are one or two drain wires 3 (two are shown) which comprise the same or similar materials as center conductor 1, such as copper, copper alloys, aluminum or aluminum alloys, noble metal-plated copper and other metal conductors. Insulation 2 may be a tape helically wrapped about center conductor 1 or may be extruded around 1.

The insulated center conductor and drain wires 3 are helically wrapped with a polymer tape 4 which has on one side a metal coat 5 and on the other side a semiconductive adhesive polymer film layer 8. Polymer tape 4 may be any polymer tape material known to be useful for wrapping around insulated signal conductors of coaxial signal cables. It is usually a thermopolymer, but may be PTFE, and is preferably a polyester tape. Tape 4 may be metal-coated in any customary way with an electrically conductive metal, aluminum being preferred. On the reverse side of tape 4 is affixed a semiconductive polymer film 8, usually a conductive carbon-filled polyester adhesive tape. Other materials could be used to achieve a thinner more flexible coating. In FIG. 1, semiconductive polymer layer 8 bridges conductive drain wires 3, which contact metal layer 5, which contacts semiconductive polymer film 8 at the fold shown at the top of the figure. At a different portion of the circumference of the cable, film 8 contacts an outer semiconductive polymer jacket 10 which protectively encloses the cable. Jacket 10 comprises a semiconductive polymer material, preferably a conductive carbon-filled fluorocarbon material, such as PFA or FEP. Other thermoplastic fluorocarbon polymers may be used instead of PFA as may other suitable thermoplastic polymers.

Figure 2:
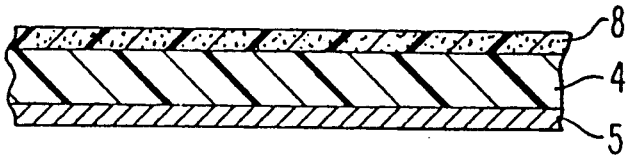
FIG. 2 describes in cross-section a metal-coated polymer film utilized in the cable.
Figure 3:
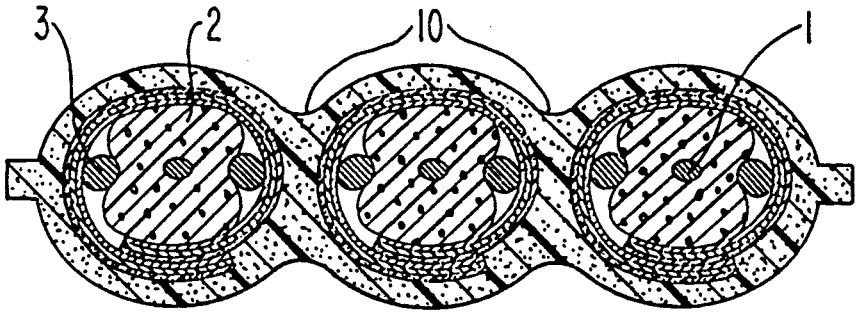
FIG. 3 provides in cross-sectional view a multiconductor flat cable of the invention.
Figure 4:
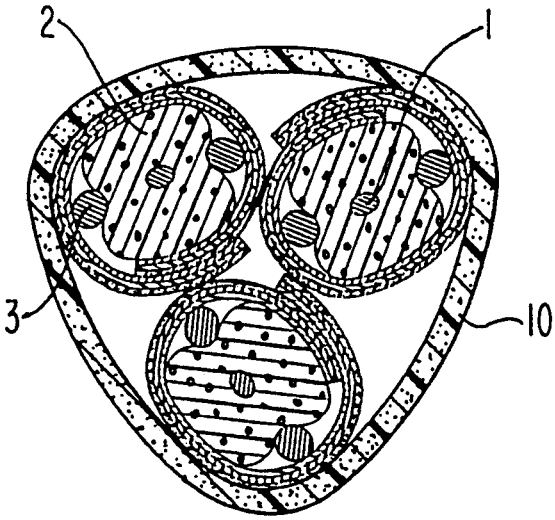
FIG. 4 discloses in a cross-sectional view a multiconductor round cable of the invention.
Figure 5:
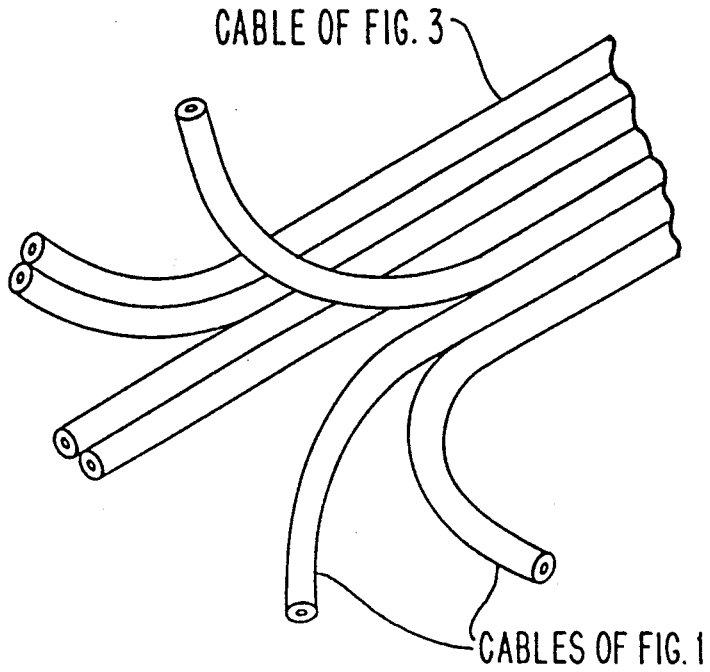
FIG. 5 shows a wiring harness of the invention made from a flat cable of FIG. 3 (interior cable structure not shown).

FIG. 2 shows a cross-sectional view of a segment of shielding tape 4. Included in layered relationship are semiconductive polymer layer 8, polymer tape 4, and metal coating 5. This construction combines the benefits of providing a definite conductive path between the jacket and shield while the cable is also processable and flexible. The use of a conductive film provides the unexpected benefit of a greatly improved electrical contact between the inside of outer jacket 10 and the outside of shield 4. This achieves a measurably more consistent electrical path from outer jacket 10 to inner shield 4 and drain wires 3 owing to the remelting of adhesive during the jacket extrusion process and to the resulting improvement in conformance of the cable to the inside of the jacket.

Another benefit is that semiconductive polymer film 8 could be designed to flow across the polyester film boundary thereby causing continuous, local electrical conductivity between aluminum layers on the inside of the shield wrapped tape layers. This improves cable shielding electrical characteristics. These advantages would apply even if the outer jacket 10 is not conductive.

Another advantage of this invention is that adhesive film 8 melts and flows during the hot extrusion process for jacketing the cable. This serves to seal the shielding system to provide better mechanical integrity and easier strippability for the cable. These advantages would apply even if coating 8 was not conductive.

Figure 6:
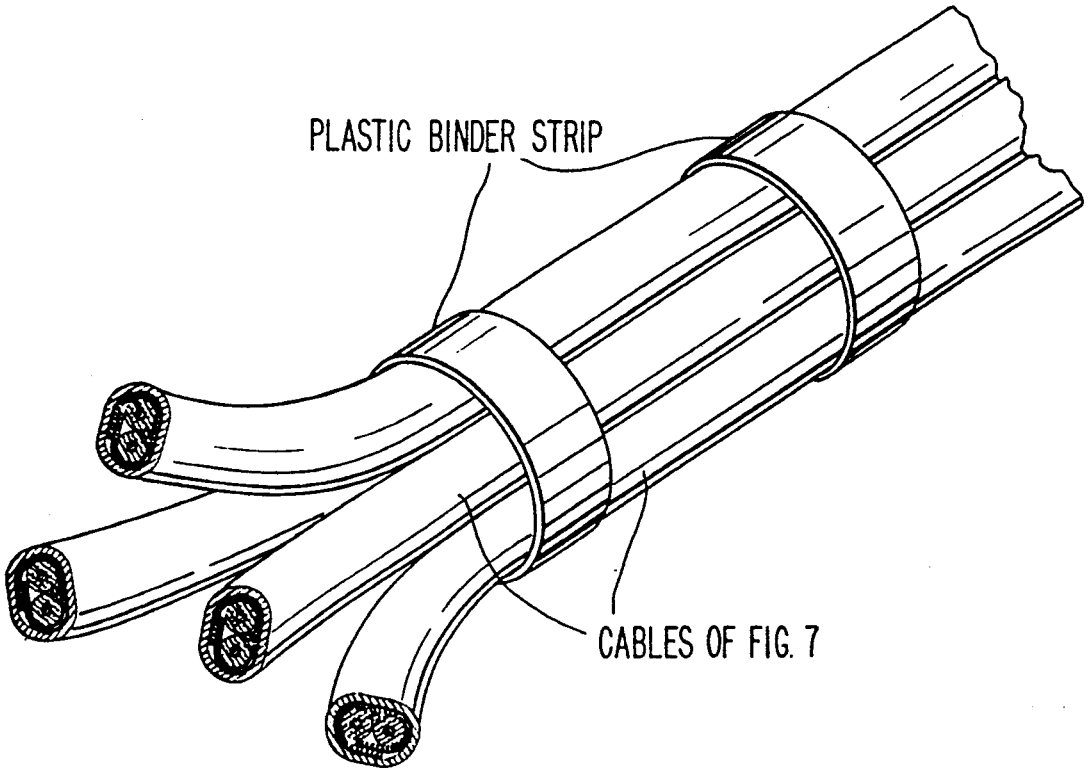
FIG. 6 describes a wiring harness of the invention made from single cables of FIG. 1 held together in a bundle by plastic binder strips (interior cable structure not shown).
Figure 7:
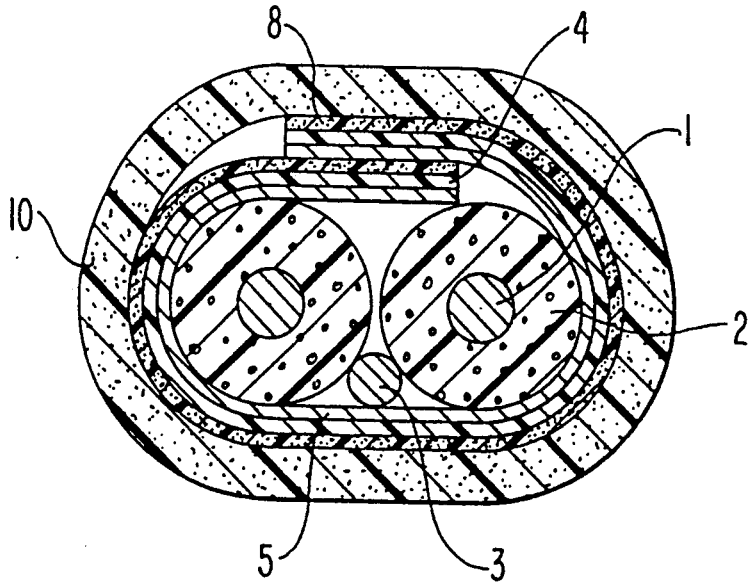
FIG. 7 depicts a twin-axial cable of the invention wherein two insulated conductors and one drain wire are wrapped as a unit with a metal-clad and semiconductive adhesive coated polymer tape and jacketed with a semiconductive jacket.

Applicant's conductively-jacketed cable may also comprise a multiconductor round or flat cable wherein several central conductors are surrounded by conductive, semiconductive, and/or insulative elements as described above and in FIGS. 3, 4, 5, and 7. The cable may also comprise a wiring harness of a plurality of units of the above cables as shown in FIG. 6. Two or more center conductors 1 each separately surrounded by insulation 2 along with one or more drain wires 3 may be wrapped as a unit with the tape of FIG. 2, metal side facing drain wires 3. Jacket 10 is then applied to the cable shown in FIG. 7.

We claim:

1. A conductively-jacketed electrical cable comprising from inside to outside:

(a) two or more conductive metal center conductors each separately surrounded by an electrically insulating material;

(b) one or more electrically conductive metal drain wires positioned parallel to said center conductors along the length of said cable outside of said insulating material;

(c) a layer of metal-coated polymer tape coated on the side opposite the metal coating with a thin adhesive layer of semiconductive polymer film and wrapped around said center conductors, said insulating materials, and said drain wires as a unit, said tape being positioned so that its metal side is adjacent said drain wires; and (d) a semiconductive thermoplastic polymer protective jacket.

2. A cable of claim 1 wherein said insulating material comprises microporous expanded polytetrafluoroethylene.

3. A cable of claim 2 wherein said polymer tape is thermoplastic polyester and said metal plated thereon is aluminum.

4. A cable of claim 3 wherein said jacket is a thermoplastic fluoropolymer.

5. A cable of claim 4 wherein said semiconductive polymer film and said semiconductive polymer jacket comprise conductive carbon-filled polymer materials.

6. A wiring harness comprising a multiplicity of electrical cables held together as a unit along a portion of their length, each cable therein comprising:

(a) two or more conductive metal center conductors each separately surrounded by an electrically insulating material;

(b) one or more electrically conductive drain wires positioned parallel to said center conductors along the length of said cable outside of said insulating material;

(c) a layer of metal-coated polymer tape coated on the side opposite the metal coating with a thin adhesive layer of semiconductive polymer film and wrapped around said center conductors, said insulating materials, and said drain wires as a unit, said tape being positioned so that its metal side is adjacent said drain wires; and (d) a semiconductive thermoplastic polymer protective jacket.

* * * * *